United States Patent [19]

Bardina et al.

[11] 4,437,479

[45] Mar. 20, 1984

[54] DECONTAMINATION APPARATUS FOR SEMICONDUCTOR WAFER HANDLING EQUIPMENT

[75] Inventors: Juan Bardina, Menlo Park; Mikel Gonzalez, San Jose, both of Calif.

[73] Assignee: Atcor, Mountain View, Calif.

[21] Appl. No.: 335,765

[22] Filed: Dec. 30, 1981

[51] Int. Cl.[3] ..... B08B 3/02

[52] U.S. Cl. ..... 134/68; 134/57 R; 134/108; 15/306 B

[58] Field of Search ..... 134/26, 28, 29, 30, 134/1, 22, 68, 72, 73, 57 R, 105, 108, 107, 131, 154, 182, 200, 111, 198; 15/302, 306 B

[56] References Cited

U.S. PATENT DOCUMENTS

| | | | |
|---|---|---|---|
| 2,980,938 | 4/1961 | Whelan | 15/306 B |
| 3,421,211 | 1/1969 | Eayes et al. | 15/306 B |
| 3,884,179 | 5/1975 | Szczepanski | 134/68 |

*Primary Examiner*—Robert L. Bleutge

*Attorney, Agent, or Firm*—C. Michael Zimmerman

[57] ABSTRACT

Apparatus for decontaminating certain types of semiconductor wafer handling equipment is disclosed. The apparatus includes a frame having structure for applying decontaminating and electrostatic elimination fluid to handling equipment. It includes a first chamber and a second chamber. The first chamber removes contaminants from handling equipment and restricts the removed contaminants to the first chamber. The second chamber includes structure for drying handling equipment. The apparatus further includes structure for removing static from dried handling equipment.

8 Claims, 7 Drawing Figures

DECONTAMINATION APPARATUS FOR SEMICONDUCTOR WAFER HANDLING EQUIPMENT

BACKGROUND OF THE INVENTION

The present invention relates to a decontamination method and apparatus, and, in particular, to such a method and apparatus designed to decontaminate certain types of semiconductor wafer handling equipment.

Integrated circuitry is formed on disks of a semiconductor material, typically silicon. These disks are referred to as wafers which must be completely free of contaminants during the formation of microelectronic circuits thereon. However, as is well known, highly corrosive residue oils, films and particulates resulting from the handling and processing of semiconductor wafers contaminate the articles which are used to handle, transport and/or store such wafers. These articles include cassette carriers and boxes, mask holders, wafer boats, boat handles and the like, all of which are generally referred to herein as semiconductor wafer handling equipment. Such handling equipment must be decontaminated after use with each batch of wafers, to prevent contaminants from one wafer batch from contaminating successive batches.

Currently, decontamination of wafer handling equipment of this type is generally accomplished by manually scrubbing the same with liquid detergent, and then drying each separately. In other words, each article is decontaminated separately in separate operations by manual labor. As can be appreciated, with the great number of wafers needed to be processed for the formation of integrated circuitry, this method of decontamination is labor inefficient. Additionally, manual means of decontamination have been found to leave particulates on such equipment of sufficient size to interfere with processing even after manual decontamination.

It is important for reliable production of integrated circuitry on semiconductor wafers, that the wafers be free of static electricity. If the wafer handling equipment carries static electricity, it can be transferred to the wafers and deleteriously affect such circuitry production. Thus, it is important that any static electricity on the wafer handling equipment be removed between use of the same with successive batches of wafers. While others, such as Bok et al., U.S. Pat. No. 921,796, Dexter et al., U.S. Pat. No. 4,208,760, and Cook U.S. Pat. No. 3,393,514, have disclosed various types of cleaning methods and apparatuses for semiconductor wafers themselves, to applicants' knowledge no one has taught how to clean the equipment used for processing such wafers. And while others e.g., Detjen, U.S. Pat. No. Re. 23,788 and German Pat. No. 2,222,688, have disclosed arrangements for cleaning food handling trays and the like, no one has taught a method or an apparatus capable of decontaminating wafer handling equipment and removing static electricity therefrom.

SUMMARY OF THE INVENTION

The present invention provides a decontamination method and apparatus for efficiently and effectively decontaminating certain types of semiconductor wafer handling equipment. The apparatus includes a frame adapted to releasably secure handling equipment thereto, and spray means for applying decontamination and electrostatic elimination fluid to handling equipment secured to the frame. The spray means is positioned to insure that handling equipment secured by the frame is within range of the spray means.

The decontamination apparatus most desirably includes separate and adjacent chambers to aid the decontamination process. The first chamber is adapted to receive handling equipment and includes a means for spraying decontaminating liquid on handling equipment. Such chamber is adapted to be sealed during the spraying operation, thereby restricting the contaminants and decontaminating liquid to the first chamber. The second chamber is adapted to be sealed when not receiving or having handling equipment unloaded therefrom. By sealing the second chamber in this way, stray contaminants from the outside environment and from the handling equipment are prevented from entering the second chamber. Moreover, since liquid is used as the decontaminant, the second chamber includes means for thoroughly drying the handling equipment before it is treated to remove static electricity. In this connection, each chamber preferably includes a leak proof door which opens and closes and serves as means for the aforesaid sealing.

The frame also most desirably includes a spray means for applying an ionized fluid to the handling equipment after it is dried, to remove static electricity therefrom. Such electrostatic elimination fluid is most desirably sprayed on the equipment before it is unloaded from the decontamination apparatus.

Each of the spray means included in the device is preferably adapted to spray the handling equipment thoroughly from a plurality of directions. For this purpose, each of the preferred spray means includes a dual set of nozzles, one of which is positioned under and the other of which is positioned over the handling equipment.

The device can be adapted to automatically and simultaneously perform the operations of loading, unloading, decontaminating, drying and electrostatic elimination.

The instant invention also includes a special fluid heater which uniformly and rapidly heats fluid passing therethrough. Such heater includes a housing having a spiral passageway which swirls the fluid for maximum contact with heating surfaces. This swirling behavior is a phenomenon known as Taylor's Vortices. The spiral passageway is simply created in the preferred embodiment by wrapping thermally conductive wirings around a heating element, and placing the wrapped element in a thermally conductive housing with the wiring contacting the housing.

The fluid heater is particularly useful for decontamination arrangements because of its compactness and the uniform and rapid heating rate of compressed gas such as nitrogen.

The instant invention includes a method of decontaminating semiconductor wafer handling equipment which includes the steps of applying decontamination fluid to the handling equipment, and thereafter applying electrostatic elimination fluid to the handling equipment which is dry. The preferred method includes the steps of loading the handling equipment into a first chamber, thereafter sealing the first chamber, applying a decontamination fluid to the handling equipment while it is within the sealed first chamber, thereafter unsealing the first chamber, moving the decontaminated handling equipment to a second chamber, sealing the second chamber, drying the handling equipment while in the second chamber and thereafter unloading the decontaminated handling equipment.

In the preferred method, the decontamination fluid with the contaminants is removed from the first chamber before such first chamber is unsealed. Additionally, the first chamber and decontaminated handling equipment therein is rinsed before the handling equipment is removed from such first chamber, to eliminate any residual contaminants and prevent the same from being spread to the second chamber.

The instant invention additionally provides a method and apparatus for simultaneously and automatically carrying out the above mentioned steps. Control means are provided to operate the various structures to decontaminate in the preferred embodiment at least 50 cassette boxes as well as other handling equipment, per hour.

Other objects and advantages of the instant invention will be described or will be appreciated more fully hereinafter with reference to the detailed description of a preferred embodiment shown in the accompanying drawing wherein:

DETAILED DESCRIPTION OF THE PREFERRED EMBODIMENT

Figure 1:
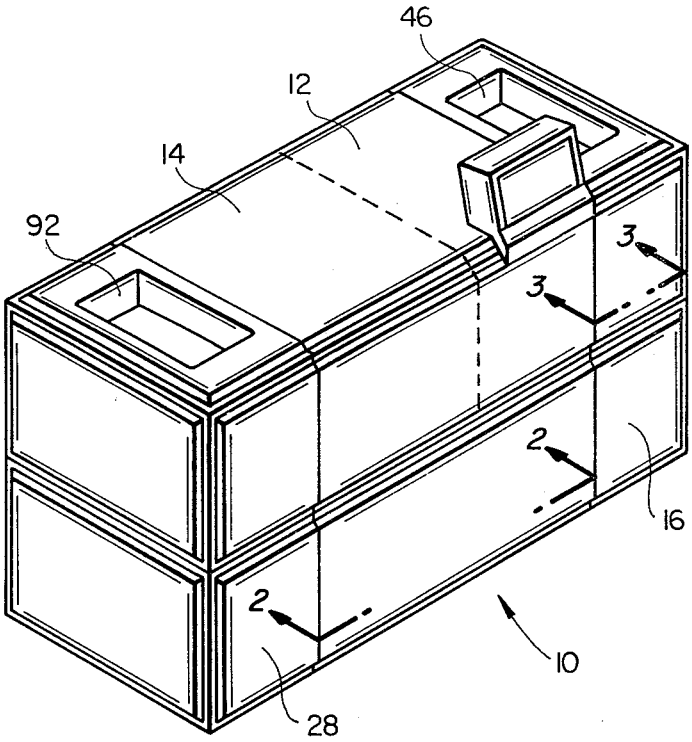
FIG. 1 illustrates, in perspective, a preferred embodiment of a decontamination apparatus in accordance with this invention.
Figure 2:
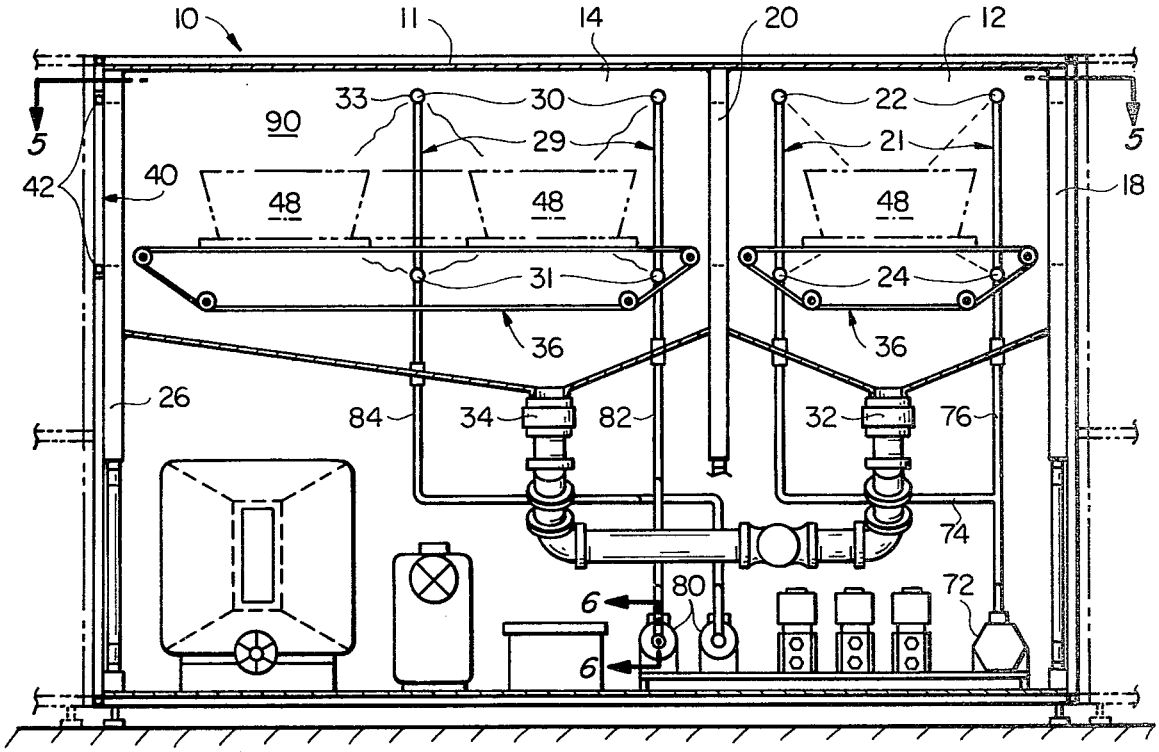
FIG. 2 taken from a plane indicated by lines 2—2 in FIG. 1 is a sectional side view of the device shown in FIG. 1.

With reference to the drawing wherein like reference characters designate like or corresponding parts throughout several views, and referring particularly to FIGS. 1 and 2, there is shown a decontamination apparatus for semiconductor wafer handling equipment generally indicated by reference numeral 10. As used herein, handling equipment means articles which are used to handle, transport and/or store such wafers. These articles include cassete carriers and boxes, mask holders, wafer boats, boat handles and the like.

Apparatus 10 includes a frame 11 defining two separate and adjacent chambers 12 and 14. The first chamber 12 is adapted to selectively communicate with the second chamber 14, and with a loading means 16 (FIG. 3) for loading handling equipment into the first chamber 12 via door structure 18. On the end of chamber 12 opposite door structure 18, there is a second door structure 20 for selectively communicating the first chamber 12 with the second chamber 14. The first chamber 12 includes spray means 21 for applying decontamination fluid and for rinsing handling equipment. On the end of chamber 14 opposite door structure 18, there is another door structure 26 for selectively communicating with second chamber 14 and with means 28 for unloading handling equipment. The second chamber 14 includes spray structure 29 for drying handling equipment. The chambers 12 and 14 include liquid drains 32 and 34, respectively, for removing liquid from the chambers.

The device further includes transport structure shown generally at 36 for moving handling equipment from the first chamber 12 and through to the second chamber 14. As will be explained more fully hereinafter with reference to FIG. 3, transport structure 36 includes four separate transport arrangements, one for each chamber, one for the loading means and one for the unloading means. Separate transport arrangements help to restrict the contaminants of handling equipment to loading means 16 and first chamber 12, and away from newly decontaminated handling equipment in the second chamber 14 and unloading means 28.

Figure 4:
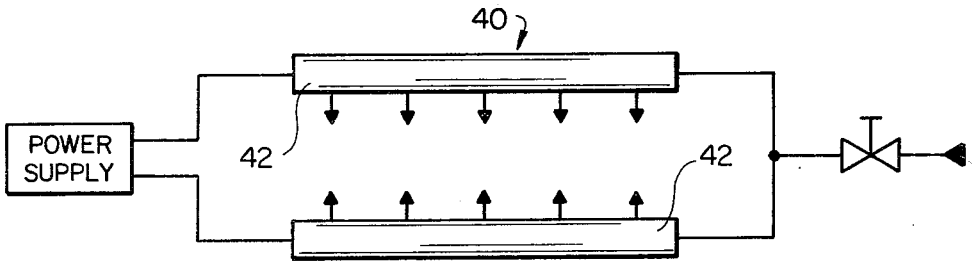
FIG. 4 is a schematic representation of spray structure for applying electrostatic elimination fluid in accordance with the invention.

As seen in FIGS. 2 and 4, the invention includes spray structure generally indicated by reference numeral 40 for applying electrostatic elimination fluid to decontaminated handling equipment prior to such equipment being unloaded but after it is dried. That is, a positively ionized fluid is applied to the dried equipment to neutralize any negative charge on the same. This will prevent electrical attraction of potential contaminates to decontaminated handling equipment once it leaves the device.

The spray structure 40 of the preferred embodiment includes a series of nozzles 42 situated above and below transport structure 36. Preferably, the electrostatic elimination fluid is formed by passing a gas such as nitrogen past positively charged electrodes to make the gas positive. The ionized gas is sprayed over the surfaces of the handling equipment to electrically neutralize its surfaces.

Each of the remaining spray structures 21 and 29 include a set of nozzles for applying the appropriate fluid above and below the handling equipment similar to spray structure 40. Situating the nozzles in this way enables the appropriate fluid to be applied thoroughly over the surfaces of the handling equipment. Spray structure 21 includes nozzles sets 22 and 24 for sequentially applying decontamination and rinse liquids. Spray structure 29 includes nozzle sets 30 and 31 for applying fluid to the handling equipment for drying.

The device further includes control means 38 which automatically and sequentially activates loading means 16, door structures 18, 20, and 26, spray structures 30 and 31 and unloading means 28. Control means 38 is explained more fully hereinafter with reference to FIG. 7. It controls the above described operations so that they take place simultaneously, independently and in the correct sequence.

Figure 3:
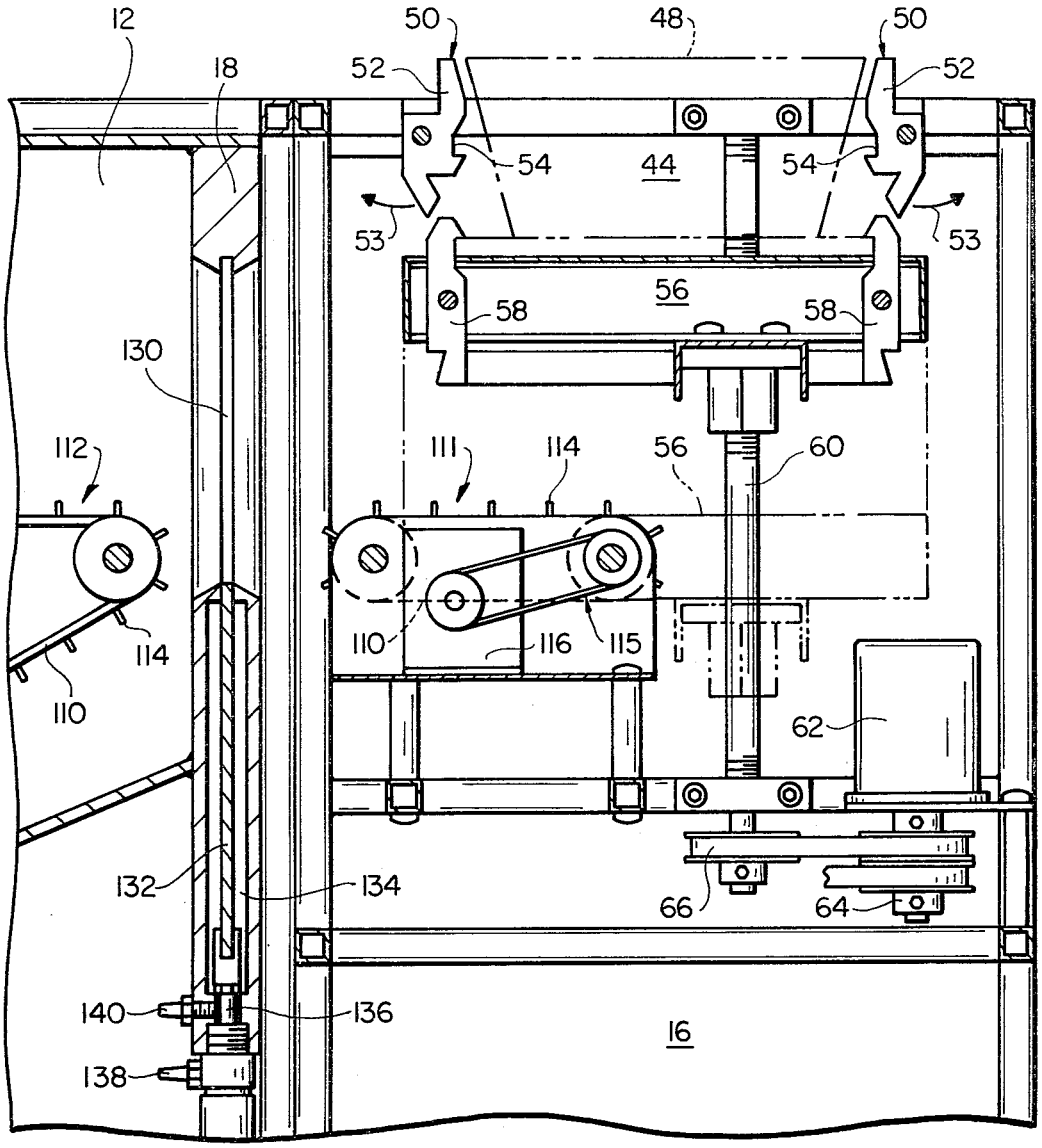
FIG. 3 is an enlarged sectional view taken along line 3—3 of FIG. 1.

With particular reference to FIG. 3 there is seen loading means 16 adjacent chamber 12 for automatically loading handling equipment into the first chamber 12. It will be appreciated that loading means 16 may be replaced by manual loading of the chamber, within the spirit and scope of this invention. Loading means 16 includes a chamber 44 having a top opening 46 (FIG. 1) for top loading of certain types of semiconductor handling equipment, such as cassette carriers and boxes, mask holders, waferboats, boat handlers and the like. Individual articles such as carriers are placed in a loading basket 48 which is the same size as standard size cassette boxes. Of course, standard size cassette boxes are directly loaded into the apparatus 10 as will be understood more fully hereinafter.

Basket 48 is placed on first engagement means shown generally at 50 which is adapted for receiving standard size baskets and cassette boxes, for initial engagement to the apparatus 10. Means 50 includes clips 52 which are pivotally secured to chamber 44. Each clip 52 has an appropriately sized notch 54 for engaging basket 48 and other similarly sized articles. A movable platform 56 in line with the first engagement means 50 includes second engagement means 58 which moves the clip 52 in the direction of arrows 53, thereby releasing first engagement means 50 and engaging the basket 48, and securing the basket 48 to platform 56.

Upon activation of the decontamination apparatus 10, the support platform 56 with handling equipment moves downward toward transport structure 36 which releases second engagement means 58 and engages basket 48. Upon an appropriate signal from control means 38, transport structure 36 moves basket 48 from loading means 16 to first chamber 12.

As can be seen from FIG. 3, loading means 16 includes threaded column 60 which turns in response to activation of a motor 62. The motor 62 includes a drive shaft 64 which turns drive belt 66 to rotate column 60. The platform 56 has a threaded aperture (not shown) for mating connection with column 60. Platform 56 moves up or down in response to the rotation of column 60. Others have disclosed apparatus which includes structure for the automatic loading of food handling trays, e.g. Pinkham U.S. Pat. No. 3,910,297 and Cook U.S. Pat. No. 3,939,514.

The invention includes unloading means 28 for automatically unloading and stacking decontaminated handling equipment. The operation and structure of unloading means 28 is identical to that of means 16 with the exception that upon activation, unloading means 28 removes handling equipment from the second chamber 14 and subsequently raises and stacks handling equipment for storage at opening 92. Others have disclosed apparatus for cleaning food handling trays which include automatic unloading of a conveyor for example, Kraeft, U.S. Pat. No. 3,768,493, Kitterman et al. U.S. Pat. No. 3,798,065 and Richard U.S. Pat. No. 3,938,533.

With particular reference to FIGS. 2 and 4, there will now be described the operation of spray structure 21 for applying decontamination fluid to handling equipment. Upon an appropriate signal from control means 38, decontamination fluid is pumped by pump 72 through conduits 74 and 76 to the nozzles 22 and 24. The fluid is a liquid of deionized water and detergent which is heated to the desired temperature. After completion of the above washing cycle, control means 38 activates spray means 22 and 24 again, for rinsing handling equipment and chamber 12. The handling equipment rinse fluid is deionized heated water.

Door structures 18 and 20 are closed during the above described operations, sealing chamber 12. In this way the corrosive film and particulate contaminants of the semiconductor wafers are restricted to the first chamber 12. Drain 32 provides a means for removing decontamination fluid with contaminants from chamber 12 after the washing cycle. It is important to remove contaminants from the device in this manner because serious damage to the apparatus 10 could result if the corrosive wafer contaminants from the first chamber 12 spread to the working parts of the apparatus 10.

Upon an appropriate signal from control means 38, drying apparatus 80 is activated for thoroughly drying decontaminated handling equipment. Upon activation, heated and, clean compressed gas flows from apparatus 80 through conduit means 82 and 84 to the nozzles 30 and 31 and onto decontaminated handling equipment. A more detailed description of a drying apparatus 80 in accordance with this invention is set forth hereinafter with reference to FIG. 6. Compressed heated nitrogen gas is used herein because it is inert, i.e., it has no contaminants, and it has a low dew point meaning it is very dry and capable of absorbing large amounts of moisture.

The preferred drying operation includes several steps. Initially, the control means 38 activates nozzles 30 which apply cold dry gas to the basket 48 and handling equipment inserted in the chamber 14. As is shown in FIGS. 2 and 4, nozzles 30 are positioned above the handling equipment and basket 48. Control means 38 activates transport structure 36, moving handling equipment and basket 48 toward door structure 26. Cold dry gas continues to be applied to the top surface of the handling equipment until the handling equipment reaches a portion 90 of second chamber 14 where nozzle 33 applies hot dry gas, particularly nitrogen, to the top surface of the handling equipment. When the handling equipment nears the end of the transport structure, the control means 38 sends an appropriate signal to transport structure 36 reversing the direction of movement of same. As the handling equipment approaches the door structure 20 on the return stroke, spray means 30, 31, and 33 apply hot dry gas, particularly compressed nitrogen to the top, bottom and side surfaces of the handling equipment. The forward and reverse steps are repeated several times to thoroughly dry the handling equipment in the preferred operation of drying in accordance with this invention. It will be appreciated that numerous combinations of spray nozzles and their sequence of activation may be used within the spirit and scope of this invention to dry the handling equipment.

With particular reference to FIG. 3, there is seen door structure 18 for selective communication between chamber 12 and loading chamber 44. The door structure 18 includes a pneumatically operated gate 132 within a track 130 which extends into a gate protective chamber 134. The gate is attached to shaft 136 which moves up and down in chamber 134 in response to fluid entering and leaving inlet and outlet means 138 of a pneumatically actuated cylinder. It will be appreciated that door structures 20 and 26 operate in an identical manner.

Figure 5:
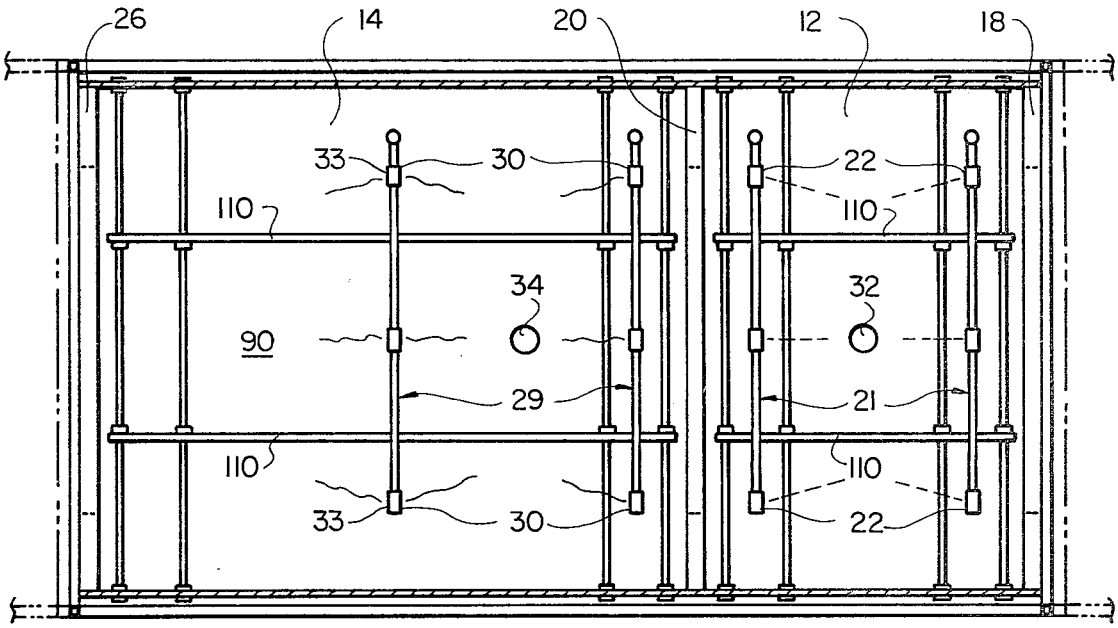
FIG. 5 is a top sectional view of the preferred embodiment of the invention, taken along line 5—5 of FIG. 2.

As explained previously, transport structure 36 includes four separate transport arrangements. As shown in FIG. 5 each separate transport structure includes a pair of parallel conveyor belts 110. With particular reference to FIG. 3, the operation of transport arrangement 111 of unloading chamber 44 and its interaction with transport arrangement 112 of first chamber 12 will now be discussed.

Each conveyor belt includes a series of upwardly extending teeth 114 for engaging basket 48 or other handling equipment. The transport arrangement 111 upon signal from control means 38 moves the basket 48 or other handling equipment toward door structure 18. After the door structure 18 opens, handling equipment is engaged by transport arrangement 112 through its teeth 114. As the transport means 112 continues to move, the basket 49 or other handling equipment is brought fully within chamber 12. Upon signal from control means 38, door means 18 closes. Transport arrangement 111 includes pulley system generally indicated at 115 which rotates belts 110 counter-clockwise in response to the activation of motor 116 by control means 38.

As will be appreciated the operation and arrangement of each separate transport structure of each chamber is generally the same and the preceding discussion of transport arrangement 111 and 112 are used merely as examples. Additionally, the method of transferring the basket 48 or other handling equipment from one chamber to the next is identical.

Fluid Heater

Figure 6:
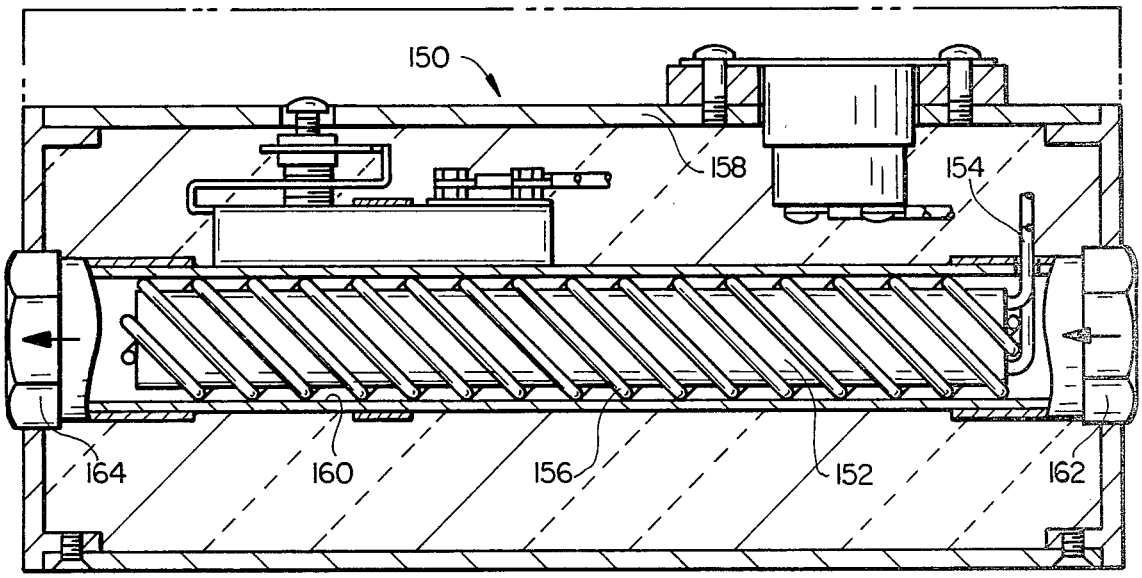
FIG. 6 is an enlarged sectional view of a fluid heater in accordance with this invention, taken along the plane indicated by line 6—6 of FIG. 3.

With particular reference to FIG. 6 there is seen a fluid heater generally indicated at 150. The apparatus includes a heating element 152 which includes electrical conduit means such as 154 for connection to an electrical power source (not shown) for heating of the element 152. The heating element 152 is spirally wrapped with conductive wiring 156, which is 10 gauge stainless steel wire. As can be seen from FIG. 6, the wiring 156 is spirally wrapped from one end of the heating element 152 to the other. The heater 150 includes a thermally conductive housing 158 having a cylindrical passageway 160 adapted for receipt of the heating element 152 with wirings 156 between inlet 162 and outlet 164. The heating element 152 with conductive wiring 150 fits snugly inside the housing 158 along cylindrical passageway 160 with the wiring 156 continuously contacting the housing 158 along the length of the heating element 152. This creates a spiral path for fluid entering the inlet 162 and exiting through outlet 164. When fluid is forced through the apparatus it is swirled in a manner known as Taylor's Vortices. As the fluid swirls about, it can be rapidly and uniformly heated by the thermally conductive housing 158, heating element 152 and thermally conductive wiring 156. When used as drying apparatus 80 in apparatus 10, compressed nitrogen is forced through fluid heater 150 and out the appropriate nozzle for drying of the handling equipment.

Fluid heater 150 as described is particularly advantageous in the decontamination apparatus for heating the drying fluid. Its construction transfers thermal energy to a fluid passing through it very rapidly. Moverover, it provides a high thermal density without the fluid being heated coming into contact with surfaces from which it may pick up contaminants.

Method

Within the spirit and scope of the instant invention is included a new method for decontaminating semiconductor wafer equipment which includes the steps of applying decontamination fluid to contaminated handling equipment and applying electrostatic elimination fluid to remove static from decontaminated handling equipment which is dry.

The method of decontamination in accordance with this invention is preferably accomplished by the steps of loading the contaminated handling equipment into a first chamber, thereafter sealing the first chamber, applying decontamination liquid to the contaminated handling equipment in the sealed first chamber, thereafter unsealing the first chamber, moving the decontaminated handling equipment into a second chamber, thereafter sealing the second chamber, drying the decontaminated handling equipment in the sealed second chamber, and unloading the second chamber. Additionally the preferred method includes the step of keeping the second chamber sealed except for loading and unloading. The preferred method further includes the step of applying electrostatic elimination fluid to dried handling equipment before unloading.

Figure 7:
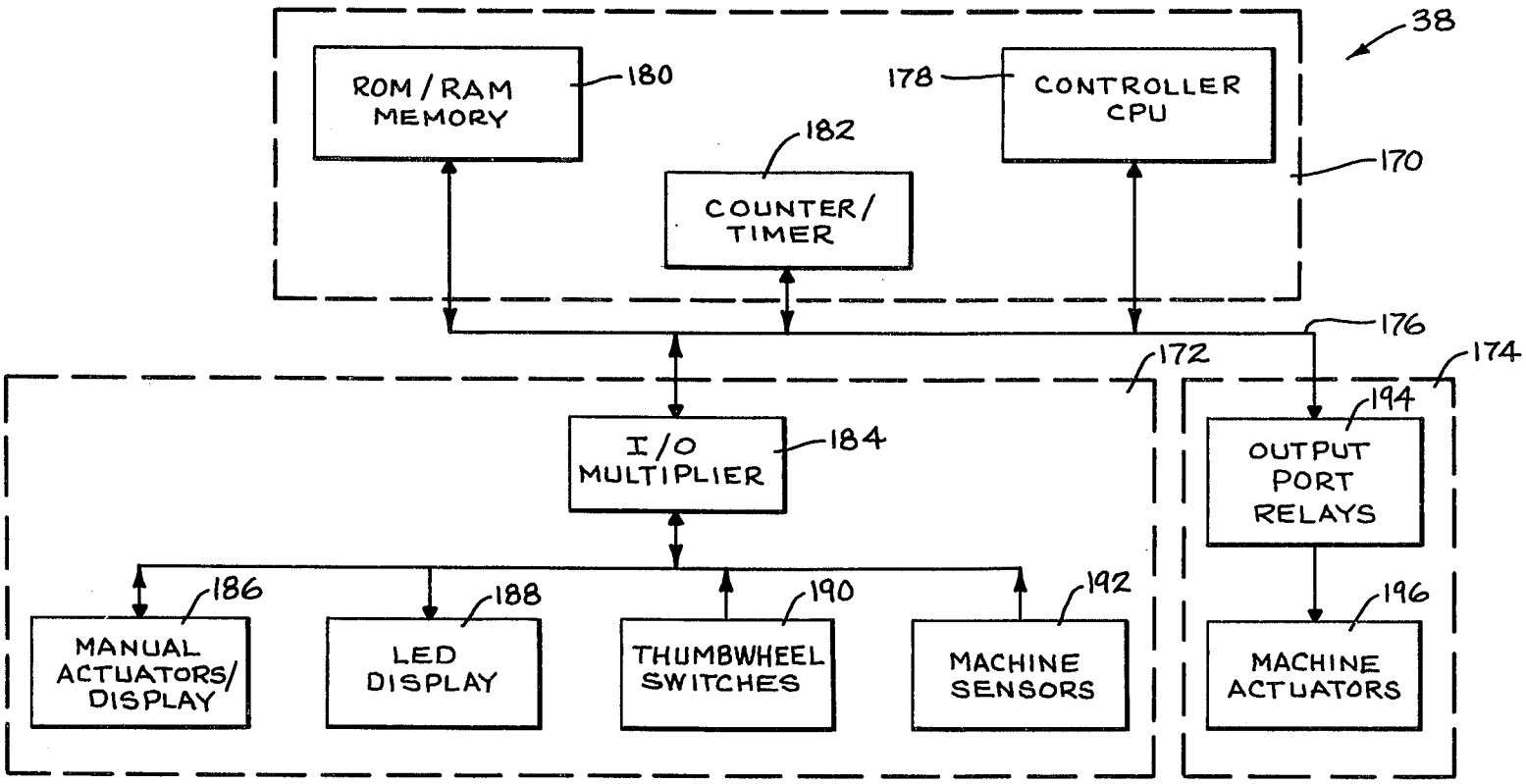
FIG. 7 illustrates in diagrammatic form a preferred embodiment of a means for controlling the operation of the various structures in accordance with this invention.

FIG. 7 illustrates in some detail, control means 38 which provides automated operation. It synchronizes movement of the handling equipment being decontaminated, with the opening of the various doors and operation of the loading and unloading means. It also operates the various spray means at the appropriate times. Moreover, it causes the application of decontaminating fluid and rinsing fluid to one batch of handling equipment in chamber 12 simultaneously with the drying of another batch of such handling equipment in chamber 14.

The control means performs the above functions by continuously monitoring manually actuated input devices and machine sensors, and responding thereto by appropriately causing machine functions. With particular reference to FIG. 7, control means 38 is made up of three principle sections enclosed within dashed lines, processor section 170, input section 172 and output section 174. Input section 172 is that portion of the controller which obtains input signals from sensors and manual actuators, processor section 170 is that portion which reacts to such input signals to develop appropriate output signals, and output section 174 is the interface between such output signals and the operating structure of the apparatus 10. The components of the various sections communicate with one another as appropriate, through data and address buses represented by bus line 176.

Processor section 170 includes a controller CPU 178, and an operating program and data memory 180. Controller 178 and memory 180 communicate with one another through bus line 176. The processor section also includes a clock counter and timer 182 similarly communicably connected with the remainder of the control means via bus line 176.

The input section 172 includes an input/output multiplexer 184 which sequentially monitors in a continuous manner, a plurality of input and output ports to determine their state. Connected to these ports are manual actuators and associated displays 186 (simply, push buttons and indicator lamps), LED output displays 188, thumbwheel input switches 190, and appropriate machine sensors 192. The manual actuators preferably include only four push buttoms for machine operation, a "start" button, a "stop" button, a "single mode" button, and a "automatic mode" select button. The LED displays 188 indicate machine status at any given time. Thumbwheel switches 190 permit setting of the wash, rinse and dry times, and the selection of appropriate diagnostic test routines. The following table lists the machine sensors included in an operable embodiment of the control means: CL Machine Sensors Door means gate microswitches (3)
Loading means hopper status
Loading platform upper limit
Loading platform lower limit
Unloading means hopper status
Unloading platform upper limit
Unloading platform lower limit
Exterior door and panel safety interlocks (2)
Air pressure sensor
Water presssure sensor
Decontamination chamber status
Drying chamber status Rinse water supply status Decontamination liquid supply status The output section includes the requisite number of output port relays as represented at 194. Most desirably, these relays are solid state to activate the machine motors and solenoid valves which make up the machine actuators represented at 196. These actuators included in the operable embodiment mentioned previously, the following:

Machine Actuators

Cold dry gas flow solenoid
Hot dry gas flow solenoid
Static elimination gas flow solenoid
Rinse water application flow solenoid
Rinse water tank inflow solenoid
Decontaminating fluid flow solenoid
Door gate actuator solenoids (3)
Loading means platform cylinder operating solenoid
Unloading means platform cylinder operating solenoids
Rinse water tank outflow solenoid
Transport arrangement drive motors (4)
Reversal of transport drive motor for dry chamber The controller most desirably is a Z-80 microprocessor available from various sources, including from Zilog Corporation of Sunnyvale, Calif. The memory 180 includes four K bytes read only memory and one K byte of read/write memory. The counter/timer provides, in essence, four independent programmable clocks.

Software

The control means software is stored in PROM memory and is structured around a multi-tasking monitor. The monitor steps through a task table containing the addresses of the current active tasks. It then jumps to and executes each task in turn. When the end of the table is reached, the monitor begins again at the beginning. To the machine operator, all active tasks appear to be operating simultaneously Each task controls a separate function of the apparatus 10. For example, one task monitors the state of the manual actuators 186 and performs the functions indicated by the same. Tasks can enable and/or disable other tasks. Information is passed between tasks through flag bytes and common memory areas.

As mentioned previously, the counter/timer 182 provides the timing necessary for operation. It interrupts the operation of the processor at programmable intervals. Interrupt service routines update individual task timing counters. Every task requiring time information keeps its own timing counter and monitors that counter for time keeping purposes.

The operating firmware stored in the ROM of the operable embodiment mentioned previously, is defined by the following tabulations stored between the hexadecimal addresses noted:

```
0000=18 01 76 AF 28 01 76 21 00 38 06 04 48 06 FF 75
0010=7E BD 28 01 76 7D 2F 77 56 BA 28 01 76 23 10 EF
0020=41 10 E9 31 00 3C ED 5E 3E 0F ED 47 3E F8 D3 00
0030=3E 95 D3 00 3E 7D D3 00 3E D5 D3 01 3E 64 D3 01
0040=3E D5 D3 02 3E 0A D3 02 3E 53 D3 03 FB 3E 80 D3
0050=07 3E 89 D3 0F 3E 9B D3 0F D3 13 DB 0A 2F E6 0F
0060=CB 27 21 80 0F 5F 16 00 19 5E 23 56 EB E9 21 94
0070=0F 11 1A 38 01 26 00 ED B0 AF 32 00 38 21 00 38
0080=11 01 38 01 12 00 ED B0 D3 04 D3 05 D3 06 D3 08
0090=D3 09 32 13 38 32 14 38 21 08 38 CB EE 7E D3 08
00A0=21 1A 38 22 18 38 2A 18 38 5E 23 56 23 22 18 38
00B0=EB E9 3A 40 38 FE 00 C2 A6 00 3E 0A 32 40 38 DB
00C0=0D 2F E6 F0 21 15 38 BE 28 04 77 C3 A6 00 5F CB
00D0=73 28 0A 21 08 38 CB CE 7E D3 08 18 08 21 08 38
00E0=CB 8E 7E D3 08 CB 7B 28 0A 21 08 38 CB C6 7E D3
00F0=08 18 08 21 08 38 CB 86 7E D3 08 CB 6B 20 0E CB
0100=63 20 0A 21 09 38 CB BE 7E D3 09 18 08 21 09 38
0110=CB FE 7E D3 09 AF BB 28 20 21 13 38 CB 66 C2 A6
0120=00 CB E6 3A 08 38 CB 7F 28 05 CB EE CD 6E 09 06
0130=0A 0E 02 CD FE 08 C3 A6 00 21 13 38 CB A6 C3 A6
0140=00 3A 41 38 FE 00 C2 A6 00 3E 0A 32 41 38 DB 0C
0150=2F E6 F0 21 16 38 BE 28 04 77 C3 A6 00 FE 00 CA
0160=A6 00 CB 7F C2 79 01 CB 77 C2 A9 01 CB 6F C2 BC
0170=01 CB 67 C2 DF 01 C3 A6 00 21 13 38 CB 66 C2 A6
0180=00 CB 6E 28 0E CB AE 21 8D 02 22 20 38 CD C0 09
0190=C3 A6 00 CB 5E C2 A6 00 CB 4E C2 A6 00 21 8D 02
01A0=22 20 38 CD A0 09 C3 A6 00 21 13 38 CB 56 C2 A6
01B0=00 CB D6 21 8D 02 22 20 38 C3 A6 00 21 13 38 CB
01C0=46 CA A6 00 CB 86 21 8D 02 22 20 38 21 08 38 CB
01D0=B6 7E D3 08 21 08 38 CB EE 7E D3 08 C3 A6 00 21
01E0=13 38 CB 46 C2 A6 00 CB C6 21 8D 02 22 20 38 21
01F0=08 38 CB AE 7E D3 08 21 08 38 CB F6 7E D3 08 C3
```

```
0200=A6 00 21 13 38 CB 9E DB 0E 2F CB 7F 28 1C 21 13
0210=38 CB DE 21 08 38 CB 5E 20 18 21 08 38 CB DE 7E
0220=D3 08 21 8D 02 22 20 38 18 08 21 08 38 CB 9E 7E
0230=D3 08 DB 0E 2F CB 77 28 1C 21 13 38 CB DE 21 08
0240=38 CB 66 20 18 21 08 38 CB E6 7E D3 08 21 8D 02
0250=22 20 38 18 08 21 08 38 CB A6 7E D3 08 DB 0E 2F
0260=CB 6F 28 1E 21 13 38 CB DE 21 08 38 CB 56 C2 A6
0270=00 21 08 38 CB D6 7E D3 08 21 8D 02 22 20 38 C3
0280=A6 00 21 08 38 CB 96 7E D3 08 C3 A6 00 21 09 38
0290=CB C6 7E D3 09 3E 96 32 42 38 21 A3 02 22 20 38
02A0=C3 A6 00 3A 42 38 FE 00 C2 A6 00 21 09 38 CB 86
02B0=7E D3 09 21 A6 00 22 20 38 C3 A6 00 21 13 38 CB
02C0=6E C2 A0 00 C3 A6 00 3A 14 38 FE 00 C2 63 03 3A
02D0=13 38 CB 5F C2 FB 02 CB 57 C2 FB 02 CB 47 28 05
02E0=21 14 38 CB C6 21 05 38 CB FE 7E D3 05 3E 05 32
02F0=4D 38 21 03 03 22 24 38 C3 A6 00 21 14 38 CB D6
0300=C3 63 03 DB 0D 2F CB 57 20 13 3A 4D 38 FE 00 C2
0310=A6 00 CD E2 08 3E 05 32 4D 38 C3 A6 00 21 05 38
0320=CB BE 7E D3 05 21 05 38 CB F6 7E D3 05 3E 05 32
0330=4D 38 21 3B 03 22 24 38 C3 A6 00 DB 0D 2F CB 5F
0340=20 13 3A 4D 38 FE 00 C2 A6 00 CD E2 08 3E 05 32
0350=4D 38 C3 A6 00 21 05 38 CB B6 7E D3 05 21 6C 03
0360=22 26 38 21 A6 00 22 24 38 C3 A6 00 DB 0E 2F CB
0370=5F CA A6 00 21 04 38 CB FE 7E D3 04 3E 14 32 43
0380=38 21 8A 03 22 26 38 C3 A6 00 3A 43 38 FE 00 C2
0390=A6 00 DB 0E 2F CB 67 20 0F 21 A6 00 22 26 38 21
03A0=B3 03 22 28 38 C3 A6 00 CD 52 09 3E 14 32 43 38
03B0=C3 A6 00 21 04 38 CB CE 7E D3 04 21 04 38 CB E6
03C0=7E D3 04 3E 82 32 49 38 21 D1 03 22 28 38 C3 A6
03D0=00 DB 0C 2F CB 5F 20 13 3A 49 38 FE 00 C2 A6 00
03E0=CD 36 09 3E 82 32 49 38 C3 A6 00 21 04 38 CB 8E
03F0=7E D3 04 21 04 38 CB A6 7E D3 04 21 A6 00 22 28
0400=38 21 6B 04 22 2A 38 21 14 38 CB 46 CA A6 00 CB
0410=CE C3 A6 00 DB 0E 2F CB 57 CA A6 00 21 13 38 CB
0420=76 C2 A6 00 CB F6 21 C7 02 22 24 38 21 04 38 CB
0430=F6 7E D3 04 3E 14 32 45 38 21 42 04 22 2E 38 C3
0440=A6 00 3A 45 38 FE 00 C2 A6 00 DB 0E 2F CB 5F 20
0450=0F 21 A6 00 22 2E 38 21 80 05 22 30 38 C3 A6 00
0460=CD 52 09 3E 14 32 45 38 C3 A6 00 21 04 38 CB BE
0470=7E D3 04 3E 14 32 44 38 21 81 04 22 2A 38 C3 A6
0480=00 DB 0E 2F CB 67 20 13 3A 44 38 FE 00 C2 A6 00
0490=CD 52 09 3E 14 32 44 38 C3 A6 00 21 13 38 CB BE
04A0=21 A6 00 22 2A 38 21 FB 04 22 2C 38 C3 A6 00 21
04B0=04 38 CB B6 7E D3 04 3E 14 32 46 38 21 C5 04 22
04C0=32 38 C3 A6 00 DB 0E 2F CB 5F 20 13 3A 46 38 FE
04D0=00 C2 A6 00 CD 52 09 3E 14 32 46 38 C3 A6 00 21
04E0=A6 00 22 32 38 21 F2 05 22 34 38 21 14 38 CB 5E
04F0=C2 A6 00 21 13 38 CB FE C3 A6 00 DB 0E 2F CB 5F
0500=CA A6 00 DB 10 2F CD C5 08 32 4E 38 21 05 38 CB
0510=DE 7E D3 05 21 05 38 CB D6 7E D3 05 21 05 38 CB
0520=CE 7E D3 05 21 2D 05 22 2C 38 C3 A6 00 3A 4E 38
0530=FE 00 C2 A6 00 21 05 38 CB 9E 7E D3 05 21 05 38
0540=CB 96 7E D3 05 DB 11 2F CD C5 08 32 4E 38 21 57
0550=05 22 2C 38 C3 A6 00 3A 4E 38 FE 00 C2 A6 00 21
0560=05 38 CB 8E 7E D3 05 21 A6 00 22 2C 38 21 14 04
0570=22 2E 38 21 14 38 CB 4E CA A6 00 CB D6 C3 A6 00
```

```
0580=21 04 38 CB E6 7E D3 04 21 04 38 CB DE 7E D3 04
0590=21 06 38 CB F6 7E D3 06 3E E6 32 4A 38 21 A6 05
05A0=22 30 38 C3 A6 00 DB 0C 2F CB 57 C2 C1 05 3A 4A
05B0=38 FE 00 C2 A6 00 CD 36 09 3E E6 32 4A 38 C3 A6
05C0=00 21 04 38 CB A6 7E D3 04 21 04 38 CB 9E 7E D3
05D0=04 21 06 38 CB B6 7E D3 06 21 A6 00 22 30 38 21
05E0=AF 04 22 32 38 21 14 38 CB 56 CA A6 00 CB DE C3
05F0=A6 00 21 13 38 CB 7E C2 A6 00 21 05 38 CB C6 7E
0600=D3 05 21 06 38 CB FE 7E D3 06 DB 12 2F CD C5 08
0610=CB 27 32 4F 38 3E 82 32 4B 38 21 04 38 CB DE 7E
0620=D3 04 3A 4F 38 FE 00 CA A4 06 DB 0C 2F CB 57 C2
0630=45 06 3A 4B 38 FE 00 C2 A6 00 CD 36 09 3E 82 32
0640=4B 38 C3 A6 00 21 04 38 CB 9E 7E D3 04 21 04 38
0650=CB D6 7E D3 04 3E 82 32 4B 38 21 63 06 22 34 38
0660=C3 A6 00 3A 4F 38 FE 00 CA A4 06 DB 0C 2F CB 4F
0670=C2 86 06 3A 4B 38 FE 00 C2 A6 00 CD 36 09 3E 82
0680=32 4B 38 C3 A6 00 21 04 38 CB 96 7E D3 04 21 04
0690=38 CB DE 7E D3 04 3E 82 32 4B 38 21 22 06 22 34
06A0=38 C3 A6 00 21 04 38 CB 96 7E D3 04 21 04 38 CB
06B0=DE 7E D3 04 3E 82 32 4B 38 21 06 38 CB BE 7E D3
06C0=06 21 05 38 CB 86 7E D3 05 21 D2 06 22 34 38 C3
06D0=A6 00 DB 0C 2F CB 57 C2 ED 06 3A 4B 38 FE 00 C2
06E0=A6 00 CD 36 09 3E 82 32 4B 38 C3 A6 00 21 04 38
06F0=CB 9E 7E D3 04 21 A6 00 22 34 38 21 0E 07 22 36
0700=38 21 14 38 CB 5E CA A6 00 CB E6 C3 A6 00 21 04
0710=38 CB EE 7E D3 04 3E 14 32 47 38 21 24 07 22 36
0720=38 C3 A6 00 3A 47 38 FE 00 C2 A6 00 DB 0E 2F CB
0730=57 20 0F 21 A6 00 22 36 38 21 4D 07 22 38 38 C3
0740=A6 00 CD 52 09 3E 14 32 47 38 C3 A6 00 21 04 38
0750=CB DE 7E D3 04 21 04 38 CB C6 7E D3 04 3E 82 32
0760=4C 38 21 6B 07 22 38 38 C3 A6 00 DB 0C 2F CB 47
0770=20 13 3A 4C 38 FE 00 C2 A6 00 CD 36 09 3E 82 32
0780=4C 38 C3 A6 00 21 04 38 CB 9E 7E D3 04 21 04 38
0790=CB 86 7E D3 04 21 A6 00 22 38 38 21 AE 07 22 3A
07A0=38 21 14 38 CB 66 CA A6 00 CB EE C3 A6 00 21 04
07B0=38 CB AE 7E D3 04 3E 14 32 48 38 21 C4 07 22 3A
07C0=38 C3 A6 00 DB 0E 2F CB 57 20 13 3A 48 38 FE 00
07D0=C2 A6 00 CD 52 09 3E 14 32 48 38 C3 A6 00 21 A6
07E0=00 22 3A 38 21 F2 07 22 3C 38 21 13 38 CB B6 C3
07F0=A6 00 21 05 38 CB EE 7E D3 05 3E 05 32 50 38 21
0800=08 08 22 3C 38 C3 A6 00 DB 0D 2F CB 47 C2 23 08
0810=3A 50 38 FE 00 C2 A6 00 CD E2 08 3E 05 32 50 38
0820=C3 A6 00 21 05 38 CB AE 7F D3 05 21 05 38 CB E6
0830=7E D3 05 3E 05 32 50 38 21 41 08 22 3C 38 C3 A6
0840=00 DB 0D 2F CB 4F C2 5C 08 3A 50 38 FE 00 C2 A6
0850=00 CD E2 08 3E 05 32 50 38 C3 A6 00 21 05 38 CB
0860=A6 7E D3 05 3A 14 38 CB 6F C4 87 09 21 A6 00 22
0870=3C 38 C3 A6 00 F5 E5 C5 AF 21 40 38 06 03 BE 28
0880=01 35 23 10 F9 C1 E1 F1 FB ED 4D F5 E5 C5 3A 13
0890=38 CB 6F 20 0D AF 21 43 38 06 0A BE 28 01 35 23
08A0=10 F9 C1 E1 F1 FB ED 4D F5 E5 C5 3A 13 38 CB 6F
08B0=20 0D AF 21 4D 38 06 04 BE 28 01 35 23 10 F9 C1
08C0=E1 F1 FB ED 4D E5 F5 67 CB 3F CB 3F CB 3F CB 3F
08D0=6F CB 27 CB 27 85 CB 27 6F 7C E6 0F 85 6F F1 7D
08E0=E1 C9 F5 E5 21 13 38 CB EF CD 6E 09 21 09 38 CB
08F0=EE 7E D3 09 06 0A 0E 02 CD FE 08 E1 F1 C9 F5 C5
```

```
0900=3E 03 D3 03 3E 55 D3 03 79 D3 03 21 09 38 CB C6
0910=7E D3 09 DB 03 FE 01 20 FA DB 03 B9 20 FB 21 09
0920=38 CB 86 7E D3 09 DB 03 FE 01 20 FA DB 03 B9 20
0930=FB 10 D8 C1 F1 C9 F5 E5 21 13 38 CB EE CD 6E 09
0940=21 09 38 CB E6 7E D3 09 06 0A 0E 02 CD FE 08 E1
0950=F1 C9 F5 E5 21 13 38 CB EE CD 6F 09 21 09 38 CB
0960=F6 7E D3 09 06 0A 0E 02 CD FE 08 E1 F1 C9 F5 E5
0970=AF D3 04 D3 05 D3 06 3A 04 38 F6 E0 D3 04 21 1A
0980=38 22 18 38 E1 F1 C9 F5 E5 21 08 38 CB BE 7E D3
0990=08 21 13 38 CB 8E 06 02 0E 0A CD FE 08 E1 F1 C9
09A0=F5 E5 21 13 38 CB B6 CB 96 CB CE AF 32 14 38 21
09B0=08 38 CB FE 7E D3 08 21 C7 02 22 24 38 E1 F1 C9
09C0=F5 E5 3A 04 38 D3 04 3A 05 38 D3 05 3A 06 38 D3
09D0=06 21 09 38 CB AE 7E D3 09 21 09 38 CB A6 7E D3
09E0=09 21 09 38 CB B6 7E D3 09 E1 F1 C9 AF 32 13 38
09F0=32 41 38 32 16 38 32 17 38 3A 41 38 FE 00 20 F9
0A00=3E 0A 32 41 38 DB 0C 2F E6 F0 21 16 38 BE 77 20
0A10=E8 FE 00 20 0D AF D3 04 D3 05 D3 06 D3 08 D3 09
0A20=18 D7 DB 10 2F 21 17 38 BE 77 20 E9 CD C5 08 FE
0A30=63 28 1E FE 18 F2 F9 09 57 CB 3F CB 3F CB 3F C6
0A40=04 4F 7A E6 07 3C 47 AF 37 17 10 FD ED 79 C3 F9
0A50=09 3E FF D3 08 D3 09 C3 F9 09 0A 3E 5E CD 81 0A
0A60=FE 09 28 0F FE 20 38 04 FE 7F 20 02 3E 3F CD 81
0A70=0A 18 DA 3E 20 CD 81 0A 7D 3C E6 07 20 F5 C3 4D
0A80=0A 12 13 7D 3C 6F FA 8B 0A 7C C9 C1 3E 0D 12 C9
0A90=3A A2 00 B7 C2 9B 0A 3E 0D 12 C9 2A CB 00 E9 79
0AA0=0F 0F 0F 0F CD AC 0A 79 CD AC 0A C9 E6 0F C6 90
0AB0=27 CE 40 27 12 13 C9 3E 20 41 12 13 10 FC C9 00
0AC0=C5 42 4B D1 E1 E3 EB 7B B2 C8 78 B1 C8 1A 77 B7
0AD0=F8 1B ED A1 FA 3D 0A 2B F6 80 77 C9 C5 48 CD 9F
0AE0=0A C1 CD 9F 0A 39 F1 E3 7C B5 57 78 B1 20 07 B2
0AF0=3E 01 C8 3E 02 C9 7A A7 C8 7E E6 7F 57 0A E6 7F
0B00=92 28 05 3E 02 F8 AF C9 0A B6 17 38 0D 7B A7 20
0B10=04 2B 0B 18 E4 23 03 C8 F9 0A 7E 17 3E 02 D0 0A
0B20=17 3E 01 D8 AF C9 0A C9 0A 6F 03 0A 67 C9 7B 02
0B30=C9 7B 02 03 7A 02 C9 21 00 00 78 B1 C8 0A B7 FA
0B40=53 0B 67 0B 0A E6 7F 6F 0A B7 F8 E5 0E 55 CD 36
0B50=11 E1 C9 E6 7F 6F C9 3A 9F 00 1F D8 E1 C9 21 03
0B60=00 18 07 21 07 00 E3 E5 E1 E3 E5 60 69 C1 32 7A
0B70=0B 78 B1 3A 7A 0B C8 ED B0 C9 00 3E FF 32 42 04
0B80=3A 78 04 67 F6 C0 32 78 04 7C E6 40 C5 0E 49 CC
0B90=36 11 C1 2A 6D 04 09 22 6D 04 54 5D 30 03 11 00
0BA0=00 1B 2A 76 04 B7 ED 52 D0 3A 9F 00 17 30 06 0E
0BB0=49 CD 36 11 C9 ED 53 76 04 C9 66 4D 00 00 00 00
0BC0=00 00 00 00 1E 06 CD 20 0C C9 1E 02 18 0A 1E 0D
0BD0=18 06 1E 05 18 02 1E 06 CD 20 0C 7E C9 1E 0D 18
0BE0=0A 1E 02 18 06 1E 05 18 02 1E 06 CD 20 0C 71 C9
0BF0=2A BA 0B 2B C9 1E 0B 18 0A 1E 07 18 06 1E 09 18
0C00=02 1E 03 CD 20 0C 5E 23 56 EB C9 1E 07 18 0A 1E
0C10=0B 18 06 1E 09 18 02 1E 03 CD 20 0C 71 23 70 C9
0C20=16 00 2A BA 0B 19 C9 ED 5B BC 0B 2A BE 0B 19 71
0C30=23 22 C5 00 13 ED 53 BC 0B CD 70 0D ED 5B BC 0B
0C40=2A BE 0B 2B 2B 72 2B 73 C9 AF 57 14 5F 0A AA 83
0C50=E6 0F 5F 0A 17 7B D8 03 14 18 F2 ED 43 C2 0B CD
0C60=49 0C 07 4F 06 00 21 49 1E 09 22 C0 0B 5E 23 56
0C70=21 47 1E 19 22 BA 0B ED 4B C2 0B CD 0C 0D 22 C2
```

```
0C80=0B CD F0 0B E5 1E 00 ED 4B C2 0B CD E6 0A FE 01
0C90=28 21 30 22 2A BA 0B 7E 23 B6 20 07 2A BA 0B 22
0CA0=C0 0B C9 2B 22 C0 0B 4E 23 46 21 47 1E 09 22 BA
0CB0=0B 18 CE 3E FF C9 AF C9 CD 5B 0C FE FF 20 07 0E
0CC0=02 CD 36 11 AF C9 2A C2 0B 23 22 BA 0B 22 C2 0B
0CD0=01 0E 00 09 EB CD 70 0D 2A C0 0B 5E 23 56 2A C2
0CE0=0B 73 23 72 2B 11 47 1F B7 ED 52 EB 2A C0 0B 73
0CF0=23 72 2A C2 0B 23 23 36 01 23 36 00 23 36 00 23
0D00=36 88 23 36 00 23 22 C5 00 3E FF C9 2A C5 00 C5
0D10=0A 17 38 04 03 23 18 F8 C1 E5 0A 77 2B 03 17 30
0D20=F9 E1 C9 D5 CD B8 0C FE FF D1 C0 2A C5 00 19 22
0D30=C5 00 D5 EB CD 70 0D C1 CD 17 0C 0E 09 CD E5 0B
0D40=0E 05 CD E1 0B C9 CD B8 0C FE 00 C8 0E 08 CD E5
0D50=0B 0E 06 CD E1 0B 2A BA 0B 11 06 00 19 22 BE 0B
0D60=21 00 00 22 BC 0B C9 2A BA 0B C9 ED 43 BA 0B C9
0D70=2A 60 04 B7 ED 52 D0 0E 57 CD 5C 11 00 00 CD B8
0D80=0C 0E 09 CD E1 0B ED 4B 7C 0D CD 0B 0C 2A BA 0B
0D90=22 7C 0D 0E 0E CD E5 0B 01 00 00 CD 17 0C CD 0F
0DA0=0C 2A C5 00 01 07 00 09 22 C5 00 C9 CD B8 0C 2A
0DB0=C5 00 23 23 22 C5 00 ED 4B 7C 0D CD 0B 0C 0E 8F
0DC0=CD E5 0B 2A BA 0B 22 7C 0D C9 00 79 32 CA 0D 2A
0DD0=7C 0D 22 BA 0B 2A BA 0B 7C B5 4F CC 5C 11 CD CA
0DE0=0B FE 09 28 09 CD D2 0B F6 03 FE 02 28 09 CD D6
0DF0=0B 4F 3A CA 0D 39 C8 CD F9 0B 22 BA 0B 18 D6 21
0F00=09 04 72 2B 73 2B 70 2B 71 11 04 00 2A 08 04 19
0E10=22 08 04 3E 00 11 06 04 CD 30 1F B5 CA 50 0E 2A
0E20=06 04 EB 21 0A 00 CD D1 1D EB 22 0A 04 CD F4 1D
0E30=11 06 04 CD 33 1F 11 30 00 19 E5 2A 08 04 C1 71
0E40=2A 0A 04 22 06 04 2A 08 04 2B 22 08 04 C3 13 0E
0E50=C9 21 0F 04 72 2B 73 2B 70 2B 71 01 05 00 C5 2A
0E60=0E 04 EB 01 00 04 CD 68 0D 2A 0C 04 44 4D 2A 0E
0E70=04 EB CD FF 0D C9 21 13 04 72 2B 73 2B 70 2B 71
0E80=2A 10 04 EB 0E 08 CD B7 0A 2A 12 04 7E FE 80 D2
0E90=AD 0E 2A 12 04 F5 2A 10 04 C1 0A 77 2A 12 04 2B
0EA0=22 12 04 2A 10 04 23 22 10 04 C3 89 0E 2A 12 04
0EB0=3E 7F A6 2A 10 04 77 C9 21 15 04 70 2B 71 CD F0
0EC0=0B EB 2A 14 04 44 4D CD 74 0E C9 21 19 04 72 2B
0ED0=73 2B 70 2B 71 2A 18 04 EB 2A 16 04 CD FB 1D C9
0EE0=21 1D 04 72 2B 73 2B 70 2B 71 2A 1C 04 EB 2A 1A
0EF0=04 CD D1 1D EB C9 0D 2A 2A 2A 2A 2A 20 45 52 52
0F00=4F 52 20 21 4A 04 70 2B 71 2A 49 04 44 4D CD 0F
0F10=09 21 41 04 34 C9 2A 0F 00 23 22 0F 00 2A 0F 00
0F20=44 4D 11 CE 04 CD FF 0D 21 41 04 36 00 01 8A 04
0F30=CD 03 0F 01 4E 01 CD 03 0F 3A 4F 01 FE 0D CA 47
0F40=0F 01 F6 0E CD 03 0F 21 8A 04 36 0C C9 3A 46 04
0F50=E6 FE 32 46 04 C9 3A 46 04 F6 08 32 46 04 C9 2A
0F60=5B 04 7D 3D 3D 4F 06 00 21 97 01 09 36 2B C9 2A
0F70=5B 04 7D D6 03 4F 06 00 21 97 01 09 36 3E C9 2A
0F80=4E 00 EC 09 00 00 00 00 00 00 00 00 00 00 00 00
0F90=00 00 00 00 B2 00 41 01 02 02 A6 00 BC 02 A6 00
0FA0=A6 00 A6 00 A6 00 A6 00 A6 00 A6 00 A6 00 A6 00
0FB0=A6 00 A6 00 A6 00 A6 00 A0 00 96 D6 01 9F F5 3A
0FC0=45 04 D6 FF C6 FF 9F C1 48 A1 1F D2 D4 0F 3A 1F
0FD0=04 32 41 04 21 1F 04 3A 41 04 BE DA E1 0F CD 16
0FE0=0F 3A 6B 04 1F D2 F3 0F 11 97 01 0E 05 CD B7 0A
0FF0=C3 FE 0F 2A 05 00 44 4D 75 08 8B 08 A8 08 00 00
```

Although the invention has been described in connection with a preferred embodiment thereof, it will be appreciated by those skilled in the art that various changes and modifications can be made without departing from its spirit. For example, various types of loading and unloading systems may be used. In addition, various black box control devices including other forms of microprocessors from those described herein may be used. Thus, it is intended that the coverage afforded applicant be limited only by the spirit of the invention as defined in the claims and their equivalent language.

What we claim is:

1. A device for decontaminating semiconductor wafer handling equipment, comprising:

a first chamber adapted to receive semiconductor wafer handling equipment, the first chamber including, an activatible means for applying decontamination liquid to handling equipment in the first chamber;

means for restricting contaminants from handling equipment to the first chamber, which means includes a generally leakproof first door covering an opening into said chamber; and means for draining decontamination liquid from the first chamber; means for opening said first door to allow handling equipment to be loaded and unloaded into said first chamber; and a second chamber adapted for receiving handling equipment from said first chamber, the second chamber including means for directing a drying fluid to handling equipment therein.

2. A device as set forth in claim 1 wherein the second chamber is a normally sealed chamber having a generally leak proof door means for opening the chamber to allow handling equipment to be loaded and unloaded therein, thereby providing means for deterring handling equipment contaminants from entering the second chamber.

3. A device as set forth in claim 1 wherein the device includes means for applying electrostatic elimination fluid to dry handling equipment.

4. A device as set forth in claim 1 wherein:

said chambers including door means between them which opens for selective communication between the chambers;

activatible transport means for moving handling equipment from the first chamber to the second chamber; and control means for synchronizing the movement of handling equipment with the opening of the door means and for activating each means for applying fluid.

5. A device as set forth in claim 4 wherein the device includes:

loading means for automatically loading handling equipment into the first chamber;

the first chamber having second door means which opens for selectively communicating with the loading means;

unloading means for automatically unloading the second chamber and storing decontaminated handling equipment;

the second chamber having second door means which opens for selectively communicating with the unloading means;

the transport means additionally moving handling equipment from the loading means to the first chamber and moving handling equipment from the second chamber to the unloading means; and the control means additionally synchronizing the movement of handling equipment between the chambers and loading and unloading means with the opening of the respective door means.

6. The device as set forth in claim 4 or 5 wherein the device includes means for applying electrostatic elimination fluid to dry handling equipment positioned on the frame adjacent the second chamber second door means.

7. A device as set forth in claim 6 wherein the electrostatic elimination fluid applied to dry handling equipment is nitrogen.

8. A device as set forth in any of claims 1, 2, 3, 4, or 5 wherein each means for applying fluid is spray means that includes at least two sets of nozzle means, at least one set of nozzle means positioned to be above handling equipment to be cleaned and at least one set of nozzle means positioned to be below such handling equipment.

* * * * *